US006244892B1

(12) United States Patent
McCarthy

(10) Patent No.: US 6,244,892 B1
(45) **Date of Patent: *Jun. 12, 2001**

(54) ELECTRICAL CONNECTOR APPARATUS AND METHOD

(75) Inventor: Dale C. McCarthy, Pensacola, FL (US)

(73) Assignee: Centerpin Technology, Inc., Gulf Breeze, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/303,197

(22) Filed: Apr. 30, 1999

Related U.S. Application Data

(63) Continuation-in-part of application No. 08/999,356, filed on Dec. 29, 1997, now Pat. No. 5,934,943, which is a continuation-in-part of application No. 08/645,514, filed on May 14, 1996, now Pat. No. 5,704,814.

(51) Int. Cl.[7] ..... H01R 4/24
(52) U.S. Cl. ..... 439/421
(58) Field of Search ..... 439/421, 427, 439/428, 431, 461, 695

(56) References Cited

U.S. PATENT DOCUMENTS

| | | |
|---|---|---|
| 916,313 | 3/1909 | Herrington . |
| 3,097,035 | 7/1963 | Despard . |
| 3,633,147 | 1/1972 | Polidori . |
| 3,744,007 | 7/1973 | Horak . |
| 3,860,320 | 1/1975 | Danner . |
| 4,013,333 | 3/1977 | Chang . |
| 4,091,233 | 5/1978 | Berman . |
| 4,374,458 | 2/1983 | Komada . |
| 4,739,126 | 4/1988 | Gutter et al. . |
| 4,759,722 | 7/1988 | Song . |
| 4,786,760 | 11/1988 | Friedhelm . |
| 5,066,248 | 11/1991 | Gaver, Jr. et al. . |
| 5,403,201 | 4/1995 | McCarthy . |
| 5,573,423 | 11/1996 | Lin et al. . |
| 5,704,814 | 1/1998 | McCarthy . |
| 5,775,934 | 7/1998 | McCarthy . |
| 5,934,943 * | 8/1999 | McCarthy ..... 439/695 |

* cited by examiner

*Primary Examiner*—Khiem Nguyen
(74) *Attorney, Agent, or Firm*—Saliwanchik, Lloyd & Saliwanchik

(57) ABSTRACT

The present invention is for an electrical connector and a method of making an electrical connector which connector has a housing having a bore therein and a housing cap having an aperture therethrough sized for an electrical conductor to pass through. An electrical conductor gripping collar is positioned between the housing and housing cap for gripping an electrical conductor threaded through the housing cap, through the gripping collar, and into the housing bore. The gripping collar is formed of a single generally flat piece of material having at least one opening therein having a plurality of gripping fingers extending from the edge of the opening for gripping an electrical conductor threaded therethrough for holding the electrical conductor to the electrical connector. The gripping collar can advantageously be made of flat material which has been stamped with a shaped die to punch a hole in the material and form the gripping fingers. The gripping collar can also be made to penetrate the insulation of the electrical conductor or to grasp the electrical conductor without penetrating the insulation as desired.

31 Claims, 2 Drawing Sheets

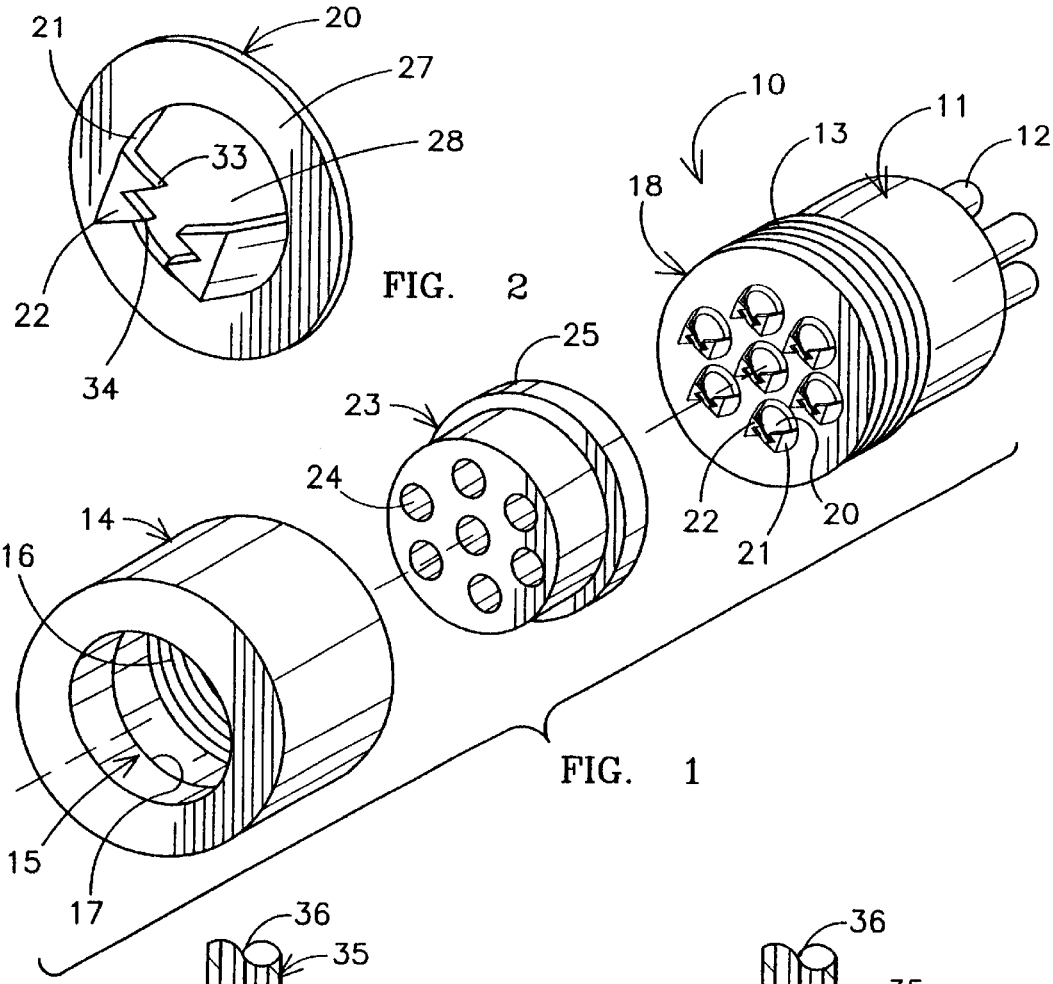
FIG. 2
FIG. 1
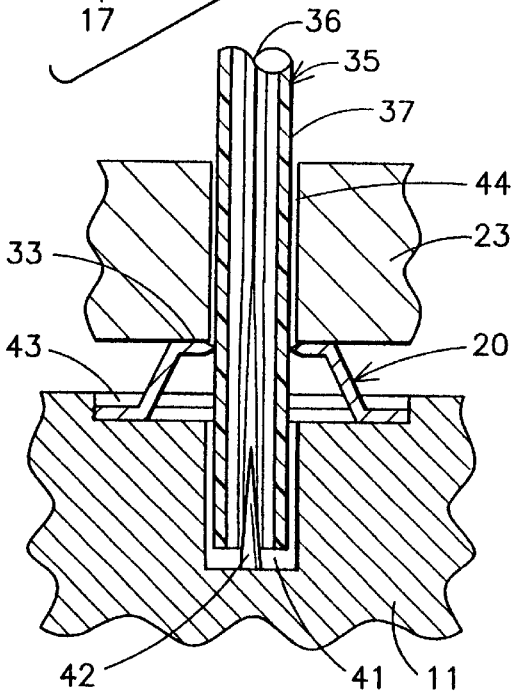
FIG. 3
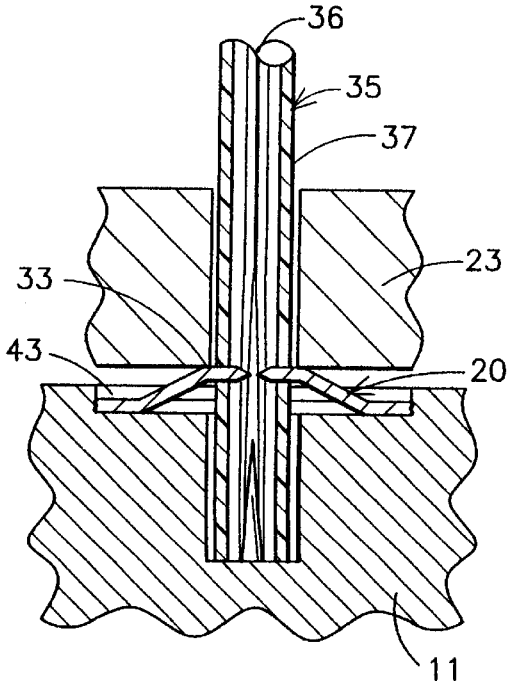
FIG. 4

ELECTRICAL CONNECTOR APPARATUS AND METHOD

This application is a continuation-in-part of my prior U.S. patent application for an electrical connector, Ser. No. 08/999,356, filed Dec. 29, 1997, now U.S. Pat. No. 5,934,943, which is a continuation-in-part of my prior U.S. patent application for an Electrical Connector, Ser. No. 08/645,514, filed May 14, 1996, now U.S. Pat. No. 5,704,814.

BACKGROUND OF THE INVENTION

The present invention relates to an electrical connector apparatus and method and especially to an electrical connector for coupling to an insulated electrical conductor having a flat one piece gripping collar for holding an electrical conductor to the electrical connector.

In the past, a wide variety of electrical wire connectors have been provided for connecting to wire ends. In a typical connector, the end of the wire is stripped of insulation and the bare wire is inserted into a connector where it can be soldered or clamped to or otherwise attached to the connector. It is also common to coat or tin the ends of an electrical conductor, with the insulation stripped from the end thereof, with a thin coat of solder. A wide variety of connectors have also been provided which removably hold a wire end to a connector.

My prior U.S. Pat. No. 5,704,814 for an Electrical Connector provides an electrical connector for coupling to an insulated electrical conductor which includes an insulated housing having threaded bores with a tapered portion therein. An electrical conductive prong extends into the housing bore for receiving an insulated electrical conductor thereon. The threaded compression collar is threadedly attached in the bore and has a bore extending axially therethrough for insertion of a wire therethrough and into the housing bore and onto a pointed prong extending into the bore. The compression collar compresses into the tapered portion of the bore to grip the electrical conductor extending therethrough.

Prior wire connectors can be seen in the following U.S. Patents. The Chang patent, U.S. Pat. No. 4,013,333, is for a wire connector having two concentric sockets adapted to be assembled one into the other. The inner socket has a conductive needle mounted therein for sliding a wire end into each end of the connector. In the U.S. patent to Danner, U.S. Pat. No. 3,860,320, a cathode cable assembly is connected to a ball-like cathode member by stripping the end portion of the cable and inserting the end portion into a sleeve which is pressed into an undersized tapered socket and which has a pointed pin therein. The U.S. patent to Friedhelm, U.S. Pat. No. 4,786,760, has a cable connector for a piezoelectric cable having an insulated cable end which is inserted into a sleeve. In the U.S. patent to Berman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

The Komada U.S. Pat. No. 4,374,458 is for a method of connecting a co-axial cable to a connector having a plurality of connections. The Herrington U.S. Pat. No. 916,313 is for a spark plug having a spark plug wire connector on the end thereof. The Despard U.S. Pat. No. 3,097,035 is for another electric cable connector for use between sections of flexible multi-conductor cable as used with portable electric power consuming equipment and a fixed power outlet. The Polidori U.S. Pat. No. 3,633,147 has a connector for underground utility applications.

The Gutter et al. U.S. Pat. No. 4,739,126, is a panel mount ground termination apparatus for termination of the outer shielding conductor of electrical cable. A cable end is passed through a closure member and through a compression member and through a termination member and into a housing. The closure member is attached to the housing to compress the termination member onto the cable. Other cable connectors can be seen in Horak, U.S. Pat. No. 3,744,007, for a three-piece coaxial cable connector and in the Song U.S. Pat. No. 4,759,722, and in the Gaver, Jr. et al. U.S. Pat. No. 5,066,248 for a solderless coaxial connector plug.

The present invention is for an electrical connector and a method of making an electrical connector which connector has a housing having a bore therein and a housing cap having an aperture therethrough sized for an electrical conductor to pass through. An electrical conductor gripping collar is positioned between the housing and housing cap for gripping an electrical conductor threaded through the housing cap, through the gripping collar, and into the housing bore. The gripping collar is formed of a single generally flat piece of material having at least one opening therein having a plurality of gripping fingers extending from the edge of the opening for gripping an electrical conductor threaded therethrough for holding the electrical conductor to the electrical connector. The gripping collar can advantageously be made of flat material which has been stamped with a shaped die to punch a hole in the material and form the gripping fingers. The gripping collar can also be made to penetrate the insulation of the electrical conductor or to grasp the electrical conductor without penetrating the insulation as desired.

SUMMARY OF THE INVENTION

An electrical connector apparatus and a method of making an electrical connector has a gripping collar for gripping an electrical conductor to the electrical connector. The electrical connector has a housing having a bore therein which may also have a center prong protruding into the bore for coupling an insulated electrical conductor thereto. The connector has a housing cap having an aperture therethrough sized for an electrical conductor to pass therethrough and an electrical conductor gripping collar positioned between the housing and housing cap. The gripping collar is formed from a single generally flat piece of material having at least one opening formed therein and having a plurality of gripping fingers extending at an angle from the edge of the opening. Each gripping finger has a gripping tip portion shaped to grip an electrical conductor for holding the electrical conductor to the electrical connector. The electrical connector allows an electrical conductor to be threaded through the housing cap and through the gripping collar opening and into the housing bore so that the cap attached to the housing over the gripping collar attaches and locks an electrical conductor to the electrical connector housing. The method of making an electrical connector having a gripping collar for gripping an electrical conductor through the electrical connector includes the selecting of an electrical connector in accordance with the apparatus and forming an electrical conductor gripping collar in accordance with the apparatus. The gripping collar is then positioning between the housing and housing cap so that an electrical connector is made which can have an electrical conductor threaded through the housing cap, through the gripping collar opening, and into the housing bore for locking the electrical conductor to the electrical connector housing with the gripping collar. The gripping collar can be formed with a plurality of openings for simultaneously attaching a plurality of electrical conductors to one electrical connector.

BRIEF DESCRIPTION OF THE DRAWINGS

Other objects, features, and advantages of the present invention will be apparent from the written description and the drawings in which:

FIG. 1 is an exploded perspective view of an electrical connector in accordance with the present invention;

FIG. 2 is a perspective view of another embodiment of an electrical connector gripping collar in accordance with the present invention;

FIG. 3 is a sectional view of an electrical conductor inserted into an electrical connector;

FIG. 4 is a sectional view in accordance with FIG. 3 having the electrical conductor attached to the electrical connector;

DESCRIPTION OF THE PREFERRED EMBODIMENTS

Figure 6:
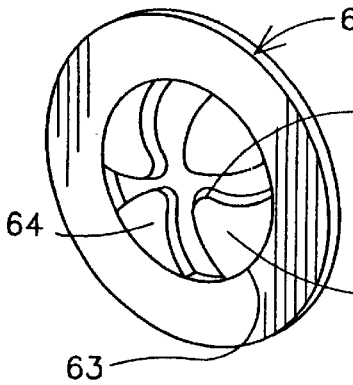
FIG. 6 is a perspective view of an alternate embodiment of a gripping collar for the electrical connector.

Referring to FIGS. 1 through 4 of the drawings, an exploded view of an electrical connector 10 in FIG. 1 has an electrical connector housing 11 having electrical contacts 12 extending from one end thereof and external threads 13 formed thereon. A housing cap 14 has an aperture 15 therethrough and has a plurality of internal threads 16 formed therein. A ledge 17 is formed in the cap 14. Conductor gripping collars 20 are mounted in the wall 18 of the housing 11 and each has an opening with a plurality of fingers 21 extending at an angle from the edge of an opening. Each finger 21 has a tip portion 22 positioned at an angle to the finger, such that the pointed tip 22 can be driven into an electrical conductor. A compression ring or member 23 has a plurality of openings 24 sized for the passage of individual electrical conductors therethrough and has an annular flange 25 for engaging the annular ledge 17 of the cap 14 when the cap is slid thereover and the internal threads 16 of the cap are attached to the external threads 13 of the housing 11. The cap 14 can be loosely attached to the connector housing 11 and electrical conductor inserted through the opening 15 in the cap 14 and through the compression ring 23 and through the griping collar 20 and into the housing 11. The cap 14 can then be tightened to force the tips 22 of the fingers 21 into the conductor.

FIG. 2 shows the gripping collar 20 in greater detail. It is formed of a single flat piece of material 27 having an aperture 28 therethrough with a pair of angled fingers 21 extending at an angle from the edge of the opening 28. Each finger 21 has a finger tip portion 22 and, although it need not in this case, the finger tip 22 is shown with a pair of pointed gripping teeth 33 and 34. As can be seen from FIG. 2, the collar 20 can be made of a single flat piece of material which has been stamped with a cutting die to form the opening 28 and the fingers 21 from the same piece of material in a single operation. This allows for the manufacture of a simple and inexpensive gripping collar.

As seen in FIGS. 3 and 4, an electrical conductor 35 having a conductor 36 and an insulating cover 37, and has been inserted through the compression ring 23 and through the electrical conductor gripping collar 20 into a bore 41 of the housing 11. The housing 11 has an electrical conductive prong 42 extending axially into the bore 41. The connector housing 11 also has a recessed area 43 for receiving the gripping collar 20 therein. In FIG. 3, the electrical conductor 35 has been inserted through the aperture 24 in the compression ring and through the gripping collar 20 into the bore 41 and pushed onto the conductive prong 42 in the housing 11.

In FIG. 4, the compression ring 23 has been moved toward the connector housing 11 to collapse the gripping fingers 21 into a more flattened position and thus drive the pointed teeth 33 through the insulation 37. If the teeth are long enough, they may contact with the conductor 36. This further secures the electrical conductor to the connector housing 11.

It will be clear that the embodiment of FIG. 1 functions in the same manner as illustrated in FIGS. 2, 3 and 4 and described above except that a plurality of conductors can be threaded through the opening 15 in the cap 14 and through individual openings 24 in the compression ring 23 and through the gripping collar 20. The compression ring 23 can then compress all of the fingers 21 of the collars 20 simultaneously by tightening the cap 14 onto the housing 11 over the compression ring 23. However, it is obvious that if the teeth 33 of the fingers 21 make contact with the conductor 36, either the connector housing must be of electrical insulating material or electrical insulation provided between the gripping collar 20 and housing 11.

Figure 5:
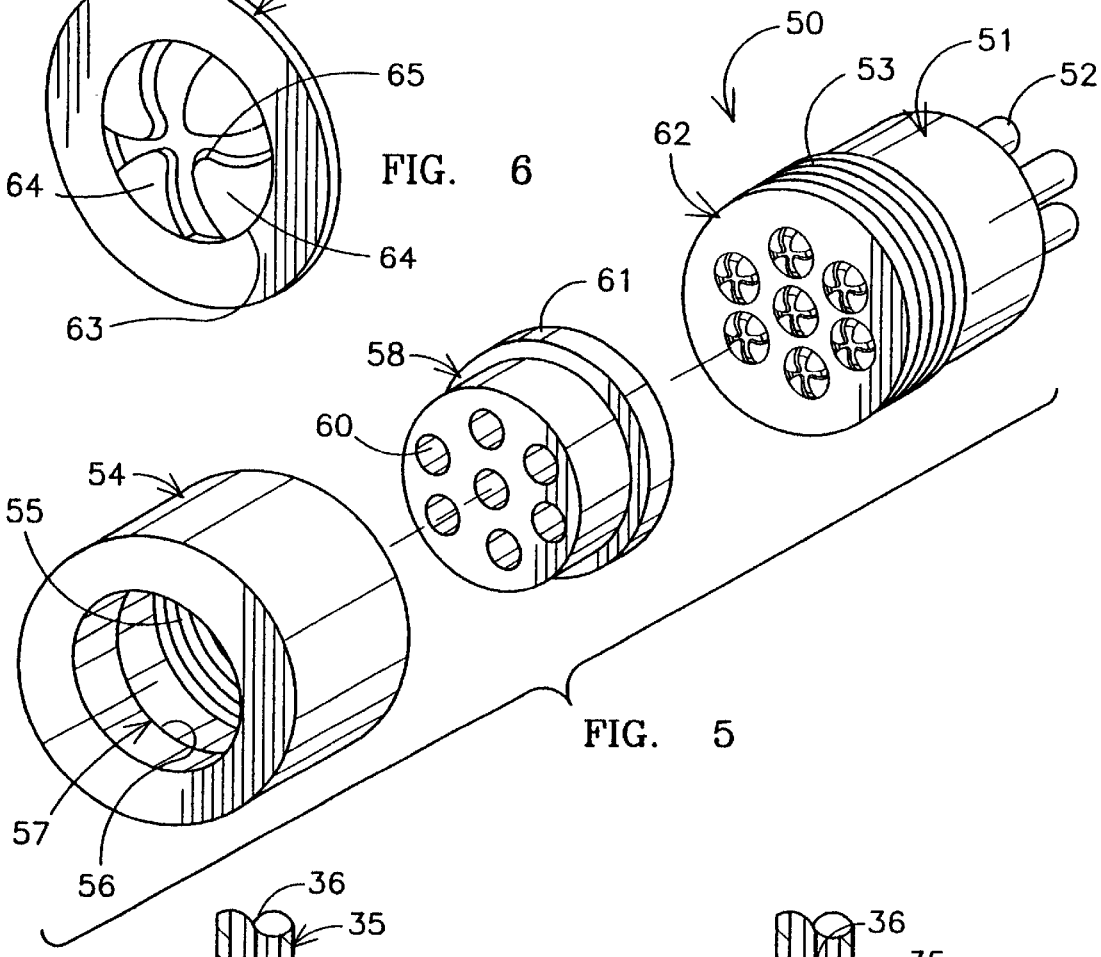
FIG. 5 is an exploded perspective view of another embodiment of an electrical connector in accordance with the present invention.

Turning now to FIG. 5, another embodiment of an electrical connector 50 is shown in an exploded view having a housing 51 having a plurality of electrical contacts 52 extending from one end thereof and having external threads 53 therearound. The housing cap 54 has a passageway 57 therethrough along with a ledge 56 therein and internal threads 55 for threaded attachment to the threads 53 of the housing 50. The collar compression ring 58 has a plurality of openings 60 passing therethrough and an annular flange 61 therearound for compressing onto the electrical conductor gripping collar 66 mounted in the wall 62 of the housing 51. The electrical connector 50, housing 51, housing cap 54, and collar compressing member 58 are all the same as illustrated in FIG. 1. The gripping collars 66 however has a plurality of fingers each with a blunted end for compressing against an electrical conductor passing therethrough without penetrating the electrical conductor's insulation.

Figure 7:
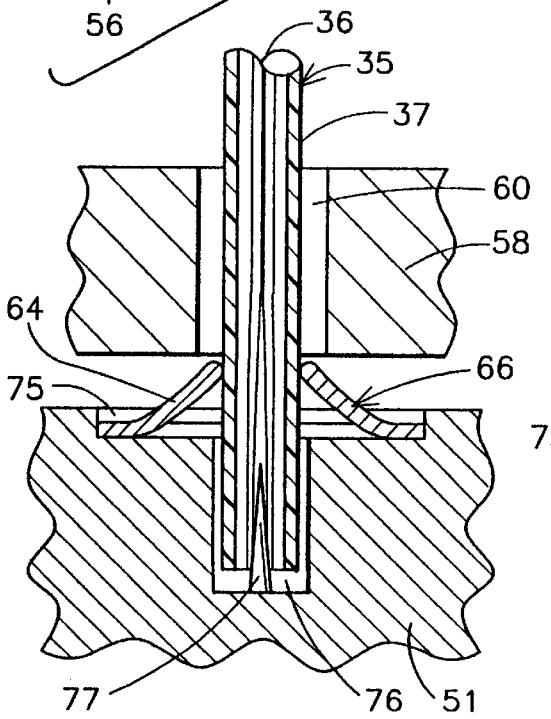
FIG. 7 is a sectional view of a portion of an electrical connector having an electrical conductor inserted thereinto.
Figure 8:
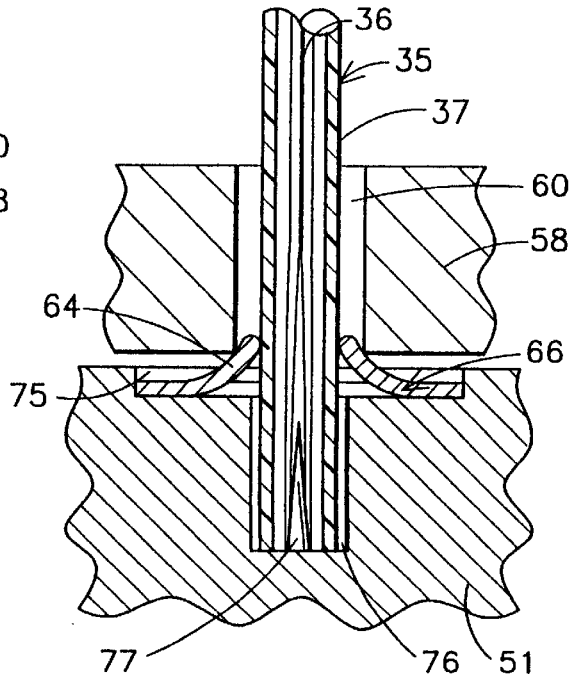
FIG. 8 is a sectional view in accordance with FIG. 7 having the electrical conductor attached to the electrical connector.

Turning to FIGS. 6, 7 and 8, an electrical conductor gripping collar 66 is formed for gripping a single electrical conductor within an electrical connector gripping collar 66. A plurality of fingers 64 extend from one edge 63 of the gripping collar 66 and each finger has a curved or blunted end 65.

The connector of FIGS. 7 and 8 shows the collar compression ring 58 in which the aperture 60 therethrough is sized for the electrical conductor 35 to pass therethrough. The electrical conductor 35 has the conductor 36 having an insulator 37 therearound and has been inserted through the opening 60 of the collar compression ring 50 through the gripping collar 66 and into the bore 76 of the housing 51. The conductor 35 is pushed onto the electrically conductive pointed prong 77 extending axially into the bore 76 to make electrical contact with the conductor 36 without having to trim the insulation 37 from the conductor. The gripping collar 66 is received in a recessed area 75 of the housing 51.

As seen in FIG. 7, the opening 60 in the compression ring 58 is of a large diameter so as to engage the sides and not the end of the fingers 64 and the fingers 64 of the gripping collar 66 are laying adjacent the electrical conductor 35 until the compression ring 50 is tightened against the sides to drive the fingers 64 against the insulation 37 of the conductor 35. As shown in FIG. 8, the fingers 64 thereby grip the conductor 35 without penetrating the insulation 37. Since the gripping collar 66 is not used to make or enhance an electrical connection, it can be formed of any material desired, either electrically conductive or non-conductive, and can be made of a polymer as well as a conductive metal without departing from the spirit and scope of the invention. Collar 66 would normally be made from a single flat piece of material which is stamped to form the opening 75 therethrough while shaping and driving the fingers 64, as shown in FIG. 6. However, it should be clear that a polymer gripping member can be formed in a plastic mold but in either case, the gripping collar 66 can be formed in a one step operation.

The method of making an electrical connector having a gripping collar for gripping an electrical conductor to the electrical connector in accordance with FIG. 1 through 4 or FIG. 5 through 8 includes the step of selecting an electrical connector having a housing having one or more bores therein and a housing cap having an aperture therethrough sized for an electrical conductor to pass therethrough and then forming an electrical conductor gripping collar for a single electrical conductor or for a plurality of electrical conductors from a generally flat piece of material having one or more openings therein and a plurality of gripping fingers extending from the edge of each opening and formed from a generally flat piece of material. Each of the gripping fingers are formed with a gripping tip portion shaped to grip the electrical conductor, either through penetration or non-penetration into the electrical conductor insulation, for holding the electrical conductor to an electrical connector. The electrical conductor gripping collar is positioned between electrical conductor housing and housing cap and may have a compressed collar member positioned between the cap and the gripping collar in the case of a gripping collar with a plurality of openings therethrough for a plurality of conductors.

In operation, the single or multiple conductors are threaded through the housing cap and through the gripping collar and into a bore of the electrical connector housing and onto an electrical connecting prong mounted in the bore. The housing cap is then tightened onto the housing to drive the gripping collar gripping fingers onto the electrical conductor inserted therethrough. For a plurality of conductors, a collar compressing member can be inserted between the connector housing cap and the connector for compressing a plurality of gripping fingers onto a plurality of conductors inserted through a single conductor gripping collar. However, it should be clear that the present invention is not to be limited to the forms shown which are to be considered illustrative rather than restrictive.

I claim:

1. An electrical connector comprising:

a housing having a bore therein and a conductive pin centered in said bore;

a compression ring having a central aperture sized for receiving an electrical conductor;

an electrical conductor gripping collar positioned between said housing and said compression ring and including an opening therein sized to receive an electrical conductor therethrough; and a housing cap for securing said compression ring to said housing;

whereby with an electrical conductor inserted through the central aperture of said compression ring and through the opening in said electrical conductor gripping collar and impaled onto said pin in said housing, further movement of said compression ring along the electrical conductor forces said electrical conductor griping collar into gripping relation with the surface of the electrical conductor.

2. The electrical connector set forth in claim 1 wherein said gripping collar is formed from a generally flat piece of deformable material and has a plurality of gripping fingers protruding upwardly from the flat piece and inwardly toward its opening for engaging the surface of an electrical conductor positioned therein.

3. The electrical connector set forth in claim 1 wherein said gripping collar is formed from a generally flat piece of deformable material and has a plurality of gripping fingers protruding upwardly from the flat piece and inwardly toward its opening and each have an inwardly projecting gripping tip portion for penetrating the surface of an electrical conductor positioned therein.

4. The electrical connector set forth in claim 2 wherein said housing is cylindrical and said housing cap has a cylindrical side wall that embraces said compression ring and fits over the outer surface of said housing, whereby with said side wall positioned on said housing and with an electrical conductor inserted through the central aperture of said compression ring and through the opening in said electrical conductor gripping collar and impaled onto said pin in said housing, further movement of said compression ring along the outer surface of the electrical conductor deforms the fingers of said electrical conductor gripping collar for engaging the electrical conductor.

5. The electrical conductor set forth in claim 4 wherein the protruding fingers of said gripping collar each have an inwardly projecting gripping tip portion and wherein the aperture in said compression ring is sized to engage the protruding fingers of said gripping collar, whereby, with said side wall positioned on said housing and with an electrical conductor inserted through the central aperture of said compressing ring and through the opening in said electrical conductor gripping collar and impaled onto said pin in said housing, further movement of said compression ring along the outer surface of the electrical conductor deforms the fingers of said electrical conductor gripping collar and forces the tip portion of each finger to penetrate the surface of the electrical conductor.

6. The electrical conductor set forth in claim 4 wherein the aperture in said compression ring is sized to lap over the protruding fingers of said gripping collar, whereby, with said side wall positioned on said housing and with an electrical conductor inserted through the central aperture of said compressing ring and through the opening in said electrical conductor gripping collar and impaled onto said pin in said housing, further movement of said compression ring along the outer surface of the electrical conductor deforms the fingers of said electrical conductor gripping collar into the opening in said electrical gripping collar and against the surface of the electrical conductor.

7. The electrical conductor set forth in claim 2 wherein said housing is cylindrical and said housing cap has a cylindrical side wall that embraces said compression ring and fits over the outer surface of said housing, and wherein an inner surface of said side wall and an outer surface of said housing are cooperatively threaded, whereby with said side wall threaded onto said housing and with an electrical conductor inserted through the central aperture of said compression ring and through the opening in said electrical conductor gripping collar and impaled onto said pin in said housing, further threaded movement of said side wall along the outer surface of said housing against said compression ring deforms the fingers of said electrical conductor gripping collar into the aperture in said compression ring and against the surface of the electrical conductor.

8. The electrical conductor set forth in claim 7 wherein said compression ring and said side wall are separate.

9. The electrical conductor set forth in claim 2 wherein the housing is cylindrical and said housing cap has a cylindrical side wall that embraces said compression ring and fits over the outer surface of said housing and wherein an inner surface of said side wall includes a protruding ring and an outer surface of said housing includes a groove complementing said protruding ring, whereby, with said side wall initially positioned onto the outer wall of said housing and with an electrical conductor inserted through the aperture of said compression ring and through the opening in said electrical conductor gripping collar and impaled onto said pin in said housing, further forcible movement of said side wall along the outer surface of said housing moves said compression ring against said electrical conductor gripping collar and deforms the fingers of said electrical conductor gripping collar into gripping relation with the surface of the electrical conductor and forces the protruding ring of said side wall into seating position with the groove in the outer surface of said housing.

10. The electrical conductor set forth in claim 9 wherein said compression ring and said side wall are integral and said compression ring forms a back wall to said side wall.

11. An electrical connector comprising:

a housing having a plurality of bores therein and a corresponding plurality of conductive pins centered in each of said bores, a compression ring having a plurality of apertures aligned with said bores and each sized for receiving an electrical conductor, a corresponding plurality of electrical conductor gripping collars positioned between said housing and said compression ring aligned respectively with said bores and each including an opening therein sized to receive an electrical conductor therethrough, and a housing cap for securing said compression ring to said housing, whereby, with electrical conductors inserted through the apertures of said compression ring and through the openings in said electrical conductor gripping collars and impaled onto said pins in said housing, further movement of said compression ring along the electrical conductors deforms said electrical conductor gripping collars into gripping relation with the corresponding electrical conductors, respectively.

12. An electrical connector in accordance with claim 11 in which each said gripping collar is formed from a generally flat piece of deformable material and has a plurality of gripping fingers, wherein each gripping finger has a pointed gripping tip angled to penetrate into the insulation cover of an electrical conductor attached to said electrical connector.

13. An electrical connector in accordance with claim 11 in which each said gripping collar is formed from a generally flat piece of deformable material and has a plurality of gripping fingers, wherein each gripping finger has a gripping tip with a general flat portion for gripping an electrical conductor attached to said electrical connector without penetrating into an insulation cover on an electrical conductor.

14. An electrical connector in accordance with claim 11 in which each said gripping collar is formed from a generally flat piece of deformable material and has a plurality of gripping fingers, wherein each gripping finger is formed with an angle to said generally flat piece of material.

15. An electrical connector in accordance with claim 11, in which each said gripping collar is formed from a generally flat piece of deformable material, and in which said generally flat piece of material is electrically conductive material.

16. An electrical connector in accordance with claim 11, in which each said gripping collar is formed from a generally flat piece of deformable material, and in which said generally flat piece of material is an electrical insulating piece of material.

17. An electrical connector in accordance with claim 11, in which each said gripping collar is formed from a generally flat piece of deformable material, and in which said generally flat piece of material has four gripping fingers formed from said material.

18. An electrical connector in accordance with claim 11, in which each said gripping collar is formed from a generally flat piece of deformable material, and in which said generally flat piece of material has two gripping fingers formed from said material.

19. An electrical connector in accordance with claim 11 in which each said gripping collar has two gripping fingers each gripping finger having a pointed gripping tip angled to penetrate into the insulation cover of an electrical conductor attached to said electrical connector.

20. An electrical connector in accordance with claim 11, in which each said gripping collar is formed from a generally flat piece of deformable material, and wherein each gripping collar has a plurality of gripping fingers formed from said generally flat material and extending from the edge of each said opening.

21. A gripping collar for gripping an electrical conductor to an electrical connector comprising:

a flat piece of material having at least one opening therein and having a plurality of gripping fingers extending at an angle from the edge of said opening, each said gripping finger having a gripping tip portion shaped to grip an electrical conductor for holding the electrical conductor to an electrical connector, whereby an electrical connector can hold an electrical conductor thereto when the conductor is passed through the gripping collar and gripped by the fingers of said gripping collar.

22. A method of making an electrical connector having a gripping collar for gripping an electrical conductor to the electrical connector comprising the steps of:

selecting an electrical connector having a housing having a bore therein and a housing cap having an aperture therethrough sized for an electrical conductor to pass therethrough;

forming an electrical conductor gripping collar from a generally flat piece of material with at least one opening therein and with a plurality of gripping fingers extending from the edge of said opening and formed from said generally flat piece of material, each said gripping finger having a gripping tip portion shaped to grip an electrical conductor for holding the electrical conductor to an electrical connector; and positioning said formed electrical conductor gripping collar between said housing and housing cap whereby an electrical connector is made which can have an electrical conductor threaded through said housing cap, through said gripping collar opening and into said housing bore for locking said electrical conductor to said electrical connector housing with said gripping collar.

23. A method of making an electrical connector having a gripping collar for gripping an electrical conductor to the electrical connector in accordance with claim 22 including forming each said gripping collar gripping finger with pointed gripping tip angled to penetrate into the insulation cover of an electrical conductor attached to said electrical connector.

24. A method of making an electrical connector having a gripping collar for gripping an electrical conductor to the electrical connector in accordance with claim 22 including forming each said gripping collar gripping finger gripping tip with a general flat portion for gripping an electrical conductor attached to said electrical connector without penetrating into an insulation cover on an electrical conductor.

25. A method of making an electrical connector having a gripping collar for gripping an electrical conductor to the electrical connector in accordance with claim 22 including forming each said gripping collar gripping finger with an angle to said generally flat piece of material.

26. A method of making an electrical connector having a gripping collar for gripping an electrical conductor to the electrical connector in accordance with claim 22 in which said generally flat piece of material is a piece of electrically conductive material.

27. A method of making an electrical connector having a gripping collar for gripping an electrical conductor to the electrical connector in accordance with claim 22 in which said generally flat piece of material is an electrical insulating piece of material.

28. A method of making an electrical connector having a gripping collar for gripping an electrical conductor to the electrical connector in accordance with claim 22 in which said generally flat piece of material has four gripping fingers formed from said material.

29. A method of making an electrical connector having a gripping collar for gripping an electrical conductor to the electrical connector in accordance with claim 22 in which each said generally flat piece of material has two gripping fingers formed from said material.

30. A method of making an electrical connector having a gripping collar for gripping an electrical conductor to the electrical connector in accordance with claim 22 includes forming each said gripping collar gripping finger with two gripping fingers each having a pointed gripping tip angled to penetrate into the insulation cover of an electrical conductor attached to said electrical connector.

31. A method of making an electrical connector having a gripping collar for gripping an electrical conductor to the electrical connector in accordance with claim 22 in which said generally flat piece of material has a plurality of holes formed therein each having a plurality of gripping fingers formed from said generally flat material and extending from the edge of each said opening.

* * * * *